US009072981B2

(12) United States Patent
Tanous

(10) Patent No.: US 9,072,981 B2
(45) Date of Patent: Jul. 7, 2015

(54) HOVERING TOY FIGURE

(71) Applicant: Tanous Works, LLC, Simpsonville, SC (US)

(72) Inventor: Gregory David Tanous, Forest Grove, OR (US)

(73) Assignee: Tanous Works, LLC, Simpsonville, SC (US)

( * ) Notice: Subject to any disclaimer, the term of this patent is extended or adjusted under 35 U.S.C. 154(b) by 0 days.

(21) Appl. No.: 14/277,902

(22) Filed: May 15, 2014

(65) Prior Publication Data

US 2014/0342632 A1 Nov. 20, 2014

Related U.S. Application Data

(60) Provisional application No. 61/823,861, filed on May 15, 2013, provisional application No. 61/875,653, filed on Sep. 9, 2013.

(51) Int. Cl.

| | |
|---|---|
| ***A63H 27/127*** | (2006.01) |
| ***A63H 27/00*** | (2006.01) |
| ***A63H 30/04*** | (2006.01) |

(52) U.S. Cl.

CPC ..... *A63H 27/008* (2013.01); *A63H 30/04* (2013.01)

(58) Field of Classification Search

USPC ..... 446/34, 36, 37, 45, 62, 330, 368, 376, 446/390

See application file for complete search history.

(56) References Cited

U.S. PATENT DOCUMENTS

| | | | | |
|---|---|---|---|---|
| 559,536 | A | 5/1896 | Nesbit | |
| 964,803 | A | 7/1910 | Olson | |
| 2,504,567 | A | 4/1950 | Morgan | |
| 3,038,274 | A | 6/1962 | Chirhart | |
| 3,626,555 | A | 12/1971 | Albertini et al. | |
| 4,244,138 | A | 1/1981 | Holahan et al. | |
| 4,654,018 | A * | 3/1987 | Farrington et al. | 446/38 |
| 4,729,748 | A | 3/1988 | Van Ruymbeke | |
| 4,988,320 | A * | 1/1991 | Rankin et al. | 446/62 |
| 5,163,861 | A * | 11/1992 | Van Ruymbeke | 446/35 |
| 5,964,638 | A * | 10/1999 | Emerson | 446/339 |
| 6,206,324 | B1 * | 3/2001 | Smith | 244/72 |
| D463,510 | S | 9/2002 | Weiser et al. | |

(Continued)

OTHER PUBLICATIONS

Zachary John Jackowski, Design and Construction of an Autonomous Ornithopter, Jun. 2009.

(Continued)

*Primary Examiner* — Kurt Fernstrom

(74) *Attorney, Agent, or Firm* — Stephen E. Kelly; Rogers Towers, P.A.

(57) ABSTRACT

A remote controlled hovering toy figure having a propulsion system, a control system, a winged body, and a wing actuation assembly. The winged body is mounted to the propulsion system, which is controlled by the control system. The wing actuation assembly is mounted to the winged body, and the wing actuation assembly is powered by the control system. The wing actuation assembly drives the wings in an oscillating flapping motion. The wings comprise apertures permitting air to pass through the wing, thus reducing the aerodynamic effect of the flapping motion. In this manner, the wings produce a softened "bouncing" flight action, thus creating a realistic flight motion. In another embodiment, the propulsion system comprises one or more rotors in a coaxial arrangement, and a rotor mast housing in the shape of a rider riding the hovering toy figure.

18 Claims, 8 Drawing Sheets

(56) References Cited

U.S. PATENT DOCUMENTS

| | | | | |
|---|---|---|---|---|
| 6,540,177 | B2 | 4/2003 | Woo et al. | |
| 6,572,428 | B1 * | 6/2003 | Weiser et al. | 446/35 |
| 6,632,119 | B2 * | 10/2003 | Chernek et al. | 446/35 |
| 6,802,473 | B2 | 10/2004 | Charron | |
| 6,840,477 | B2 | 1/2005 | Hamamoto et al. | |
| 6,938,853 | B2 * | 9/2005 | Pines et al. | 244/11 |
| 7,255,305 | B2 * | 8/2007 | Earl et al. | 244/11 |
| 7,536,823 | B2 | 5/2009 | Brint | |
| 7,895,779 | B2 * | 3/2011 | Schnuckle | 40/417 |
| 8,286,907 | B2 * | 10/2012 | Dohi et al. | 244/13 |
| 8,382,546 | B2 | 2/2013 | Van Ruymbeke | |
| 8,602,348 | B2 * | 12/2013 | Bryant | 244/12.4 |
| 2012/0115390 | A1 * | 5/2012 | Fuchiwaki et al. | 446/35 |

OTHER PUBLICATIONS

Stanley S. Baek, Autonomous Ornithopter Flight with Sensor-Based Bahavior, May 17, 2011.

Nicholas Deisadze, Toward Biologically Inspired Human-Carrying Ornithopter Robot Capable of Hover, Apr. 2013.

* cited by examiner

HOVERING TOY FIGURE

CROSS REFERENCE TO RELATED APPLICATIONS

Pursuant to 35 U.S.C. §119(e), this application claims the benefit of U.S. Provisional Patent Application Ser. No. 61/823,861, filed on May 15, 2013, and the benefit of U.S. Provisional Patent Application Ser. No. 61/875,653, filed on Sep. 9, 2013, the entire contents of both of which are incorporated herein by this reference.

BACKGROUND

1. Field of the Invention

The present invention relates generally to the field of remote controlled flying toys, and more particularly, to a hovering toy figure that simulates the flight of birds, insects, reptiles, mammals, and mythical creatures having wings that support flight in a flapping motion.

2. Description of Related Art

Past winged toy figures rely on rapidly flapping wings to create lift and corresponding flight. These toys commonly rely on ornithopter-style flapping assemblies, and they are usually unstable and difficult to maneuver. In addition, the arrangement of wings in these toy figures does not produce a realistic flight simulation of the actual figure. Instead, these toys appear to be mechanical and awkward in appearance during flight.

The present invention seeks to overcome these deficiencies by providing a wing flapping assembly that produces a realistic simulation of flight.

SUMMARY OF THE INVENTION

The hovering toy figure comprises a propulsion system, a control system, a winged body, and a wing actuation assembly. The winged body is mounted to the propulsion system, which is controlled by the control system. The wing actuation assembly is mounted to the winged body, and the winged actuation assembly is powered by the control system, which comprises all of the electrical components for operation of the remote controlled toy figure. The propulsion system comprises any one of a number of known remote controlled, propeller driven lift units.

The winged body generally comprises one or more side panels and two or more wings. The wings are configured either with or without apertures that enable the passage of air through the wings. In effect, the apertures remove surface area from the wings, thus reducing the aerodynamic forces generated by the wings during the flapping motion. The wings comprise a first spine to provide form and stiffness to the wing material. The first spine has a base and a distal end, wherein the base connects to the wing actuation assembly, as described below.

In some embodiments, it is preferable for the wing to comprise a second spine, which simulates the second finger or third finger of a Chiropteran-style wing. The second spine is attached to the wing in proximity to the second finger or third finger of the wing. The first and second spines are oriented on the wing such that the spines cross tips in the proximity of the wrist of the wing, with the distal end of the first spine crossing above the tip of the second spine. The first spine and the second spine are separated to form a flex zone between the attachment means of the respective spines. On the upstroke of the wing, the wing actuation assembly lifts the first spine, and the wing bends at the flex zone such that the wing distal end droops as the wing is raised. At the top of the upstroke, the wing distal end snaps to an upright position due to its momentum, and the down stroke of the flapping cycle begins again. During the down stroke of the wing, the wing distal end straightens out, and the second spine abuts the crossing first spine such that the first and second spines provide stiffness across the flex zone along the full length of the wing. In this manner, when the wing droops on the upstroke and straightens on the down stroke, the action of the wing appears more realistic during flight of the toy figure.

The wing actuation assembly comprises the components necessary to actuate wing movement in a flapping motion. For example, in one embodiment the wing actuation assembly comprises a frame having a base, vertical struts, and a servo. The servo has a rotating arm, which is connected to a linking assembly. As the arm rotates, the motion of the arm drives the linking assembly up and down in a cyclical manner, which drives the wings up and down in the flapping movement. During flight, the flapping wings cause a "bouncing" effect, making the hovering toy figure appear to be life-like during flight. The bouncing effect becomes more pronounced when there are no wing apertures, or when such apertures are relatively small. The bouncing effect is minimized, or even eliminated, when the area of the apertures approaches that of the overall wing surface area. To further enhance the life-like appearance of the hovering toy figure, the wings pivot about an axis that is inclined at an angle ranging from about 15-degrees to about 75-degrees as measured from horizontal.

In one embodiment, the propulsion system comprises a primary rotor and a secondary rotor configured in a co-axial orientation. A motor drive unit drives the primary rotor and the secondary rotor via at least one rotor mast. The propulsion system further comprises a housing disposed around the rotor mast for providing lateral support to the rotor mast. The housing can be configured in the shape or form of a figure seated on the body and riding the hovering toy figure.

DETAILED DESCRIPTION

With reference to the drawings, the invention will now be described with regard to the best mode and the preferred embodiment. In general, the device is a remote-controlled, hovering toy figure in the shape of a winged bird, reptile, mammal, or mythical creature, wherein the flapping wings simulate flight of the figure. The embodiments disclosed herein are meant for illustration and not limitation of the invention. An ordinary practitioner will appreciate that it is possible to create many variations and combinations of the following embodiments without undue experimentation.

By way of example and not limitation, the following discussion will generally present the hovering toy FIG. 99 in the context of a dragon-shaped body. However, it will be appreciated that the hovering toy FIG. 99 may take the form of a variety of other creatures, such as bird, reptile, mammal, or mythical creature. As used herein, the terms "right," "left," "forward," "rearward," "top," "bottom," and the like refer to directions relative to the conventional orientation of the figure. For example, the head is at the "forward" portion of the figure's body, and the tail is positioned at the "rearward" portion of the figure's body. The term "horizontal" means a plane generally parallel to the ground or other surface above which the hovering toy FIG. 99 is flying. The term "vertical" means the direction generally perpendicular to the ground or other surface above which the hovering toy FIG. 99 is flying. The term "electronic signal" means any wireless electromagnetic signal transmitted from a wireless control device 5 to the control system 15 (shown generically in FIG. 6) for controlling the hovering toy FIG. 99. In the most common embodiment, the electronic signal is a radio frequency signal typical for radio controlled (RC) toys.

Figure 1:
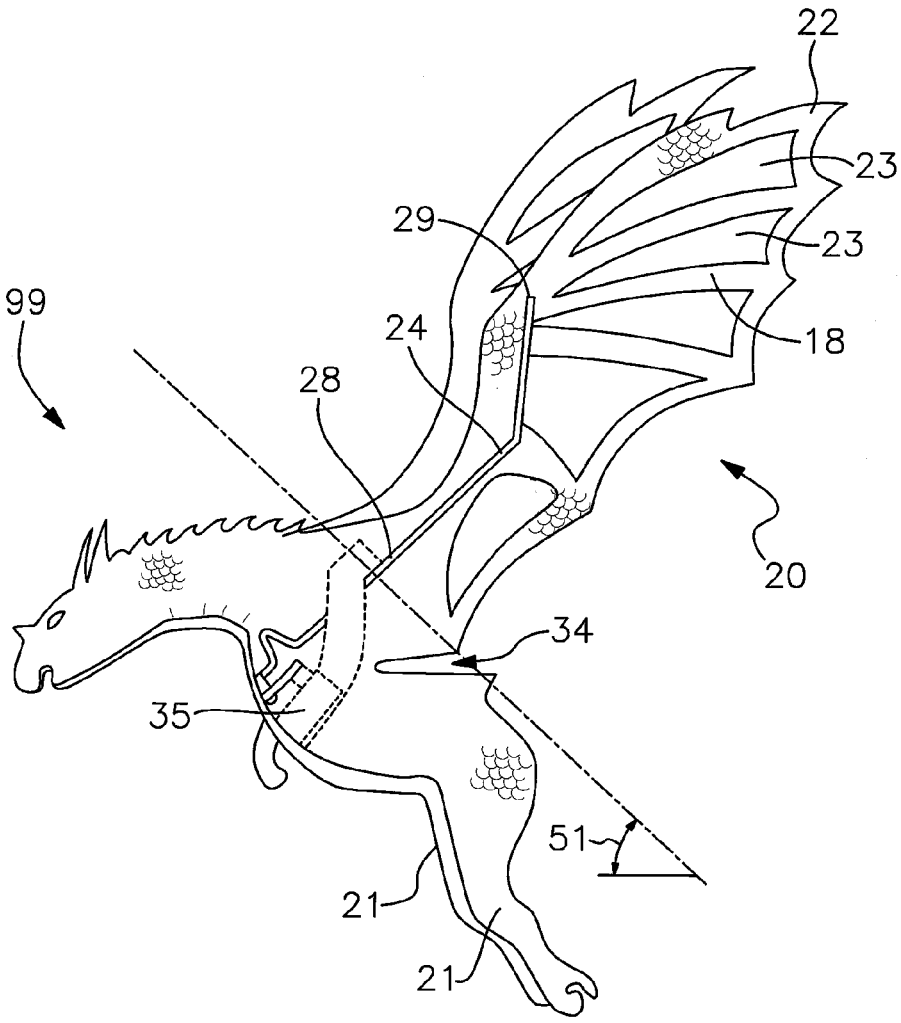
FIG. 1 is an elevation of one embodiment of the remote controlled hovering toy figure with the propulsion system removed and the left arm of the body removed, thereby showing a typical placement of the wing actuation assembly.
Figure 2:
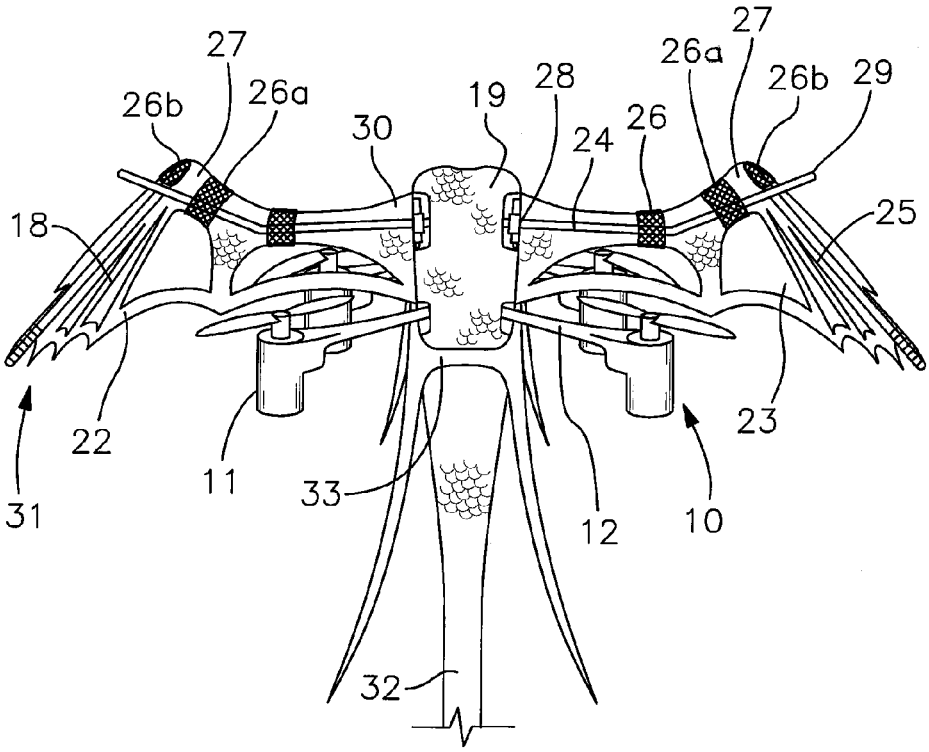
FIG. 2 is a rear view elevation of one embodiment of the remote controlled hovering toy figure during the upstroke of the wings.
Figure 3:
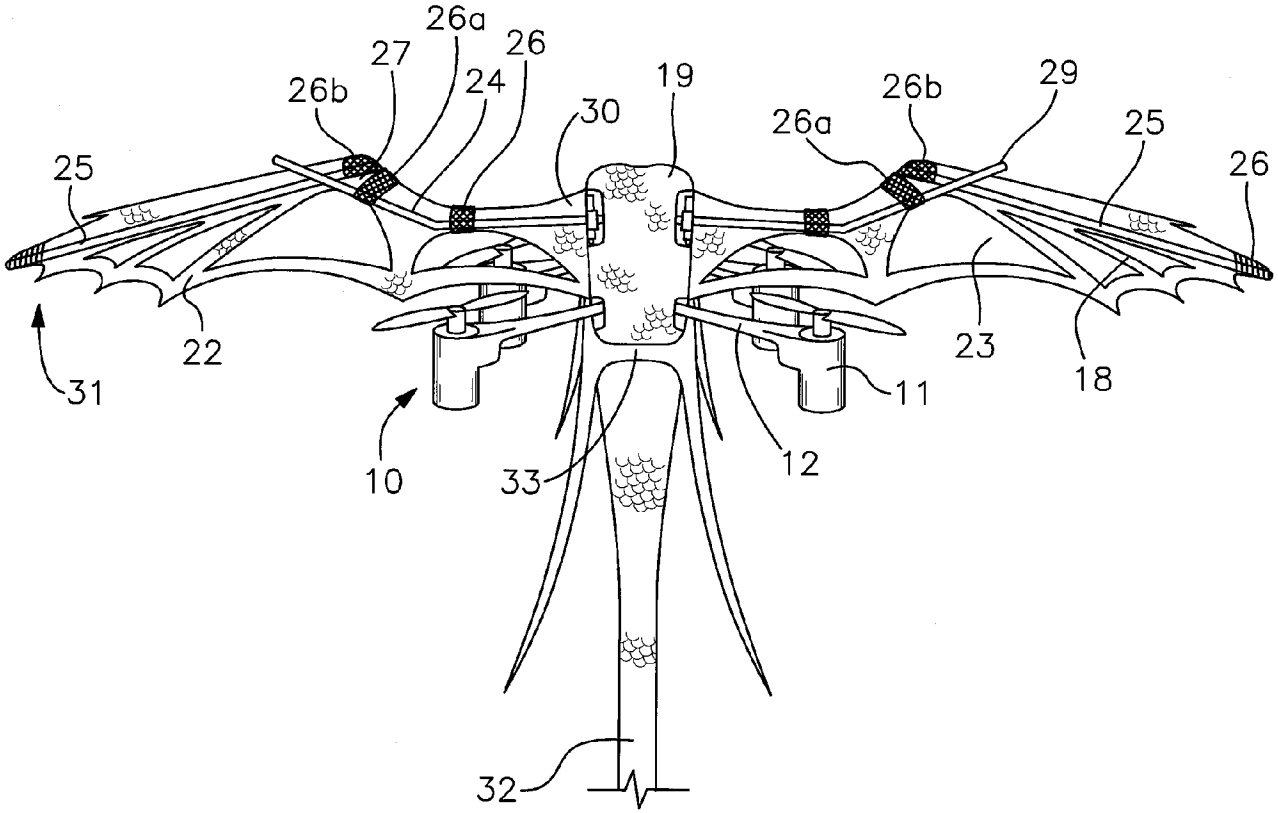
FIG. 3 is a rear view elevation of one embodiment of the remote controlled hovering toy figure during the down stroke of the wings.

Referring to FIGS. 1-3, the hovering toy FIG. 99 generally comprises a propulsion system 10, a control system 15, a winged body 20, and a wing actuation assembly 35. The winged body 20 is mounted to the propulsion system 10, which is controlled by the control system 15. The wing actuation assembly 35 can be mounted to either the propulsion system 10, the winged body 20, or both, and the winged actuation assembly 35 is powered by the control system 15, as discussed below.

The propulsion system 10 comprises any one of a number of known remote controlled, propeller driven lift units that comprises at least one propeller unit 11. For example, the propulsion system 10 comprises any one of a number of known quadcopters or hexacopters, which generally comprise four propeller units 11 or six propeller units 11, respectively, arranged in a substantially co-planar configuration. The propeller units 11 are oriented vertically to provide lift to the hovering FIG. 99. As an alternative, the propeller units 11 could be oriented substantially vertically, being angled or canted slightly towards the winged body 20. This configuration of the propeller units 11 creates a dihedral stabilizing effect on the overall hovering toy FIG. 99. In other words, canting the propeller units 11 toward the body 20 results in the propeller units 11 creating a thrust vector that has a horizontal component directed toward the body 20. The propeller units 11 are generally connected by a frame 12, which provides structural support and rigidity to the propulsion system 10. It will be appreciated that the components of such propulsion systems 10 include components such as propellers, electric remote controlled motors, gyroscopes, accelerometers, collision avoidance features, and the like.

The propulsion system 10 is controlled by a control system 15 (generically depicted in FIG. 6), which comprises all of the electrical components for operation of the remote controlled toy FIG. 99. The control system 15 typically comprises a wireless receiver for receiving wireless signals from a wireless control device 5 (shown in FIG. 7), a power source such as a battery, a circuit board, and other electronic components and wiring necessary to create electrical connectivity between the receiver, power source, and the motorized propeller units 11 of the propulsion system 10. The main components of the control system 15 are attached to either the propulsion system 10 or the winged body 20, or both. A removable attachment is preferable so that damaged components can be removed and replaced in the event of a destructive crash landing. However, a permanent attachment of the control system 15 and its components is sufficient.

The winged body 20 takes the form of the hovering toy FIG. 99, whether the form be that of a bird, a reptile, an insect (e.g. a butterfly), a mammal (e.g. a bat), or a mythical creature (e.g. a dragon). The winged body 20 generally comprises one or more side panels 21 or other housing or housing-like member, and two or more wings 22. In embodiments having two side panels 21, it is advantageous, but not necessary, for the winged body 20 to additionally comprise connectors, spacers, or lateral support members 33 between the side panels 21 such that the side panels 21 are held in a relatively fixed position with respect to each other. The side panels 21 or housing comprises a mount 34 for mounting the winged body 20 to the propulsion system 10. The mount 34 is configured such that the frame 12 of the propulsion system 10 snugly and removably mates with the mount 34. The propulsion system 10 and winged body 20 can be further secured together by connection members, such as glue, tape, clips, latches, clasps, or an equivalent member. The side panels 21 and wings 22 are constructed of thin, lightweight, flexible, and durable material. Many types of plastics, such as polyethylene materials, are suitable for this construction. Mylar is a non-limiting example of such material. Other examples include injection-molded plastic.

The wings 22 of the body 20 have a support 30 attached to the body 20, and a tip 31 extending away from the body 20. The wings 22 are configured either with or without apertures 23. The apertures 23 enable the passage of air through the wings 22. In effect, the apertures 23 remove surface area from the wings 22, thus reducing the aerodynamic forces generated by the wings 22 during the flapping motion. The apertures 23 are sized and oriented to produce the desired aerodynamic effect of the wings 22. In embodiments with no apertures 23, the flapping wings 22 create the largest aerodynamic forces for any given shape of wing 22. However, fitting the wings 22 with larger apertures 23 or a greater number of apertures 23 reduces the overall surface area of the wings 22, which then generate smaller aerodynamic forces during the flapping motion. Based on the surface area removed from the wings 22 by the apertures 23, the aerodynamic forces produced by the flapping wings 22 is proportioned to the lift and other aerodynamic forces produced by the propulsion system 10. That is, apertures 23 can be adjusted so that the wing-flapping forces are greater than or less than the typical forces produced by the propulsion system 10.

When apertures 23 are present in the wings 22, it is preferable to orient the apertures 23 in shapes that promote the overall appearance of the hovering toy FIG. 99. For example, when the FIG. 99 is in the shape of a dragon or a bat, the apertures 23 are shaped in a curved fanning orientation to simulate removal of portions of the dactylopatagium major, the dactylopatagium medius, the plagiopatagium, or any combination of these membranes in a manner that accentuates the fingers 18 of the wing 22. In embodiments where the hovering toy FIG. 99 takes the form of a butterfly, the apertures 23 could be in the shape of circles or ovals to simulate the markings on the butterfly wings.

The wings 22 comprise a first spine 24 to provide stiffness and form to the wing material. The spine 24 is selected from material that provides the optimum combination of strength, stiffness, and weight. For example, in most embodiments that have Mylar wings 22, the first spine 24 is a wire or thin rod of metal or plastic. The first spine 24 can be bent or contoured to conform to the shape of the wing 12. The first spine 24 runs along the wing 22, terminating at some point along the length of the wing 22. The termination point depends on the contour and shape of the wing 22. The first spine 24 is attached to the wing 22 by means for attaching the spine 24 to the wing 22, such attachment means 26 being glue, tape, ties, fasteners, clips, or the like.

The first spine 24 has a base 28 and a distal end 29, wherein the base 28 is operably connected to the wing actuation assembly 35 such that the first spine 24 extends along the wing 22, and the distal end 29 extends beyond the termination point of the connectivity between the first spine 24 and the wing 22, or a first spine connectivity termination point 26*a*. In some embodiments, the user may desire the wing 22 to resemble Chiropteran wings 22, such as the wings of a bat or a dragon. In these embodiments, it is preferable for the wing 22 to comprise a second spine 25, which simulates the second finger or third finger of the Chiropteran wing 22. The second spine 25 is attached to the wing 22 by an attachment means 26 in proximity to the second finger or third finger of the wing 22. The first and second spines 24, 25 are oriented on the wing 22 such that the spines 24, 25 cross tips in the proximity of the wrist of the wing 22, with the distal end 29 of the first spine 24 crossing above the tip of the second spine 25. See FIGS. 2 & 3. As shown in FIGS. 2 and 3, the first spine 24 and the second spine 25 are separated to form a flex zone 27 between the attachment means 26 of the respective spines 24, 25. That is, the second spine 25 is attached to the wing 22 at a second spine connectivity termination point 26*b* that is located between the first spine connectivity termination point 26*a* and the tip 31 of the wing 22 such that a space between the first spine connectivity termination point 26*a* and the second spine connectivity termination point 26*b* is a flex zone 27 in the wing 22. The second spine 25 is oriented such that the distal end 29 of the first spine 24 and a tip of the second spine 25 cross in proximity to the flex zone 27.

On the upstroke of the wing 22, the wing actuation assembly 35 lifts the first spine 24, as described below. As the first spine 24 is lifted, the wing 22 bends at the flex zone 27 such that the wing tip 31 droops as the wing 22 is raised, and the spines 24, 25 separate from contact with each other. At the top of the upstroke, the wing tip 31 snaps to an upright position due to its momentum, and the down stroke of the flapping cycle begins again. During the down stroke of the wing 22, the wing tip 31 straightens out, and the second spine 25 is placed into contact with the first spine 24 such that the first and second spines 24, 25 provide stiffness across the flex zone 27 along the full length of the wing 22. In this manner, when the wing 22 droops on the upstroke and straightens on the down stroke, the action of the wing 22 appears more realistic during flight of the toy FIG. 99.

In another embodiment of the wings 22, the attachment means 26 of the first spine 24 to the wing 22 permits the wing 22 to rotate about the spine 24 as the wing 22 proceeds through the flapping motion. This embodiment of the wings 22 is particularly useful when the angle 51 approaches 90-degrees so that the flapping motion is more horizontal than vertical. In this orientation, the wing 22 is rotatably adjusted about the first spine 24 during the forward stroke such that the wing 22 is oriented at about 45-degrees from horizontal, thus pushing air in a downward direction and creating lift during the forward stroke. Near the end of the forward stroke, the wing 22 rotates about 90-degrees around the first spine 24 such that on the backward stroke, the wing 22 is again oriented at about 45-degrees from horizontal, again pushing air in a downward direction and creating lift. Thus, the wings 22 generate lift during the forward and backward strokes of the flapping motion. In this embodiment, the attachment means comprises notches, tabs, stops, or other similar features to prevent over-rotation of the wing 22.

Optionally, the winged body 20 can comprise one or more access hatches 19 so that the user can access the internal components of the propulsion system 10, the control system 15, or the wing actuation assembly 35. The location, orientation, and configuration of such access hatches depends on the overall shape of the winged body 20 and the flying toy FIG. 99.

In some embodiments of the winged body 20, the body 20 comprises a tail 32. The tail 32 may or may not be a structural or aerodynamic feature of the toy FIG. 99. For example, the tail 32 could be maneuverable, such as with servos, to form an aerodynamic rudder at the rearward part of the toy FIG. 99. As another alternative, the tail 32 could be weighted to provide ballast to the flying toy FIG. 99. Alternately, the tail 32 could be included merely for aesthetics, with no weights or movable features.

Figure 4:
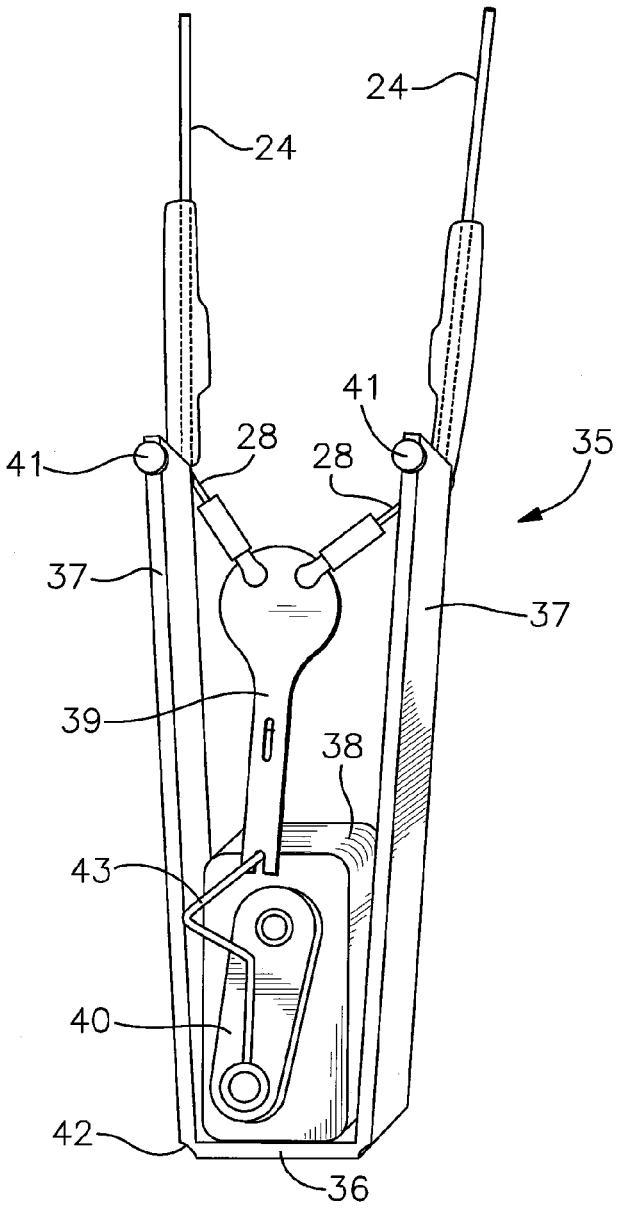
FIG. 4 is a perspective view of one embodiment of the wing actuation assembly at the top of the upstroke of the wings.
Figure 5:
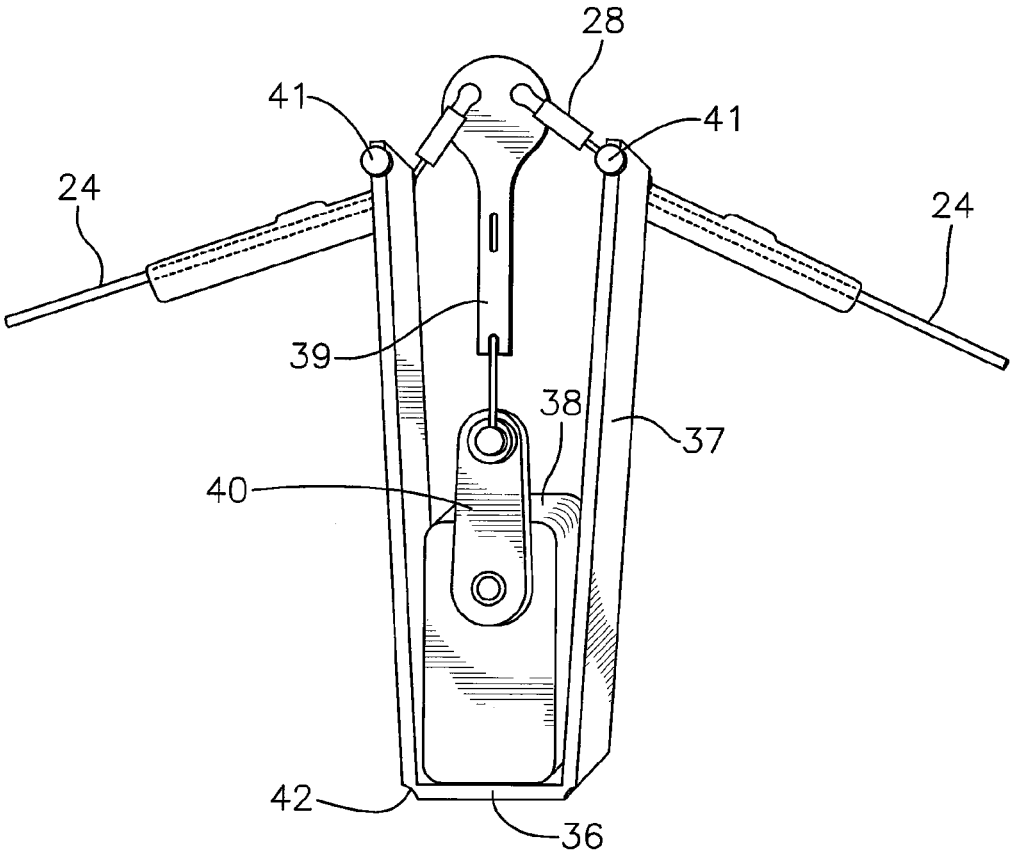
FIG. 5 is a perspective view of one embodiment of the wing actuation assembly at the bottom of the down stroke of the wings.
Figure 6:
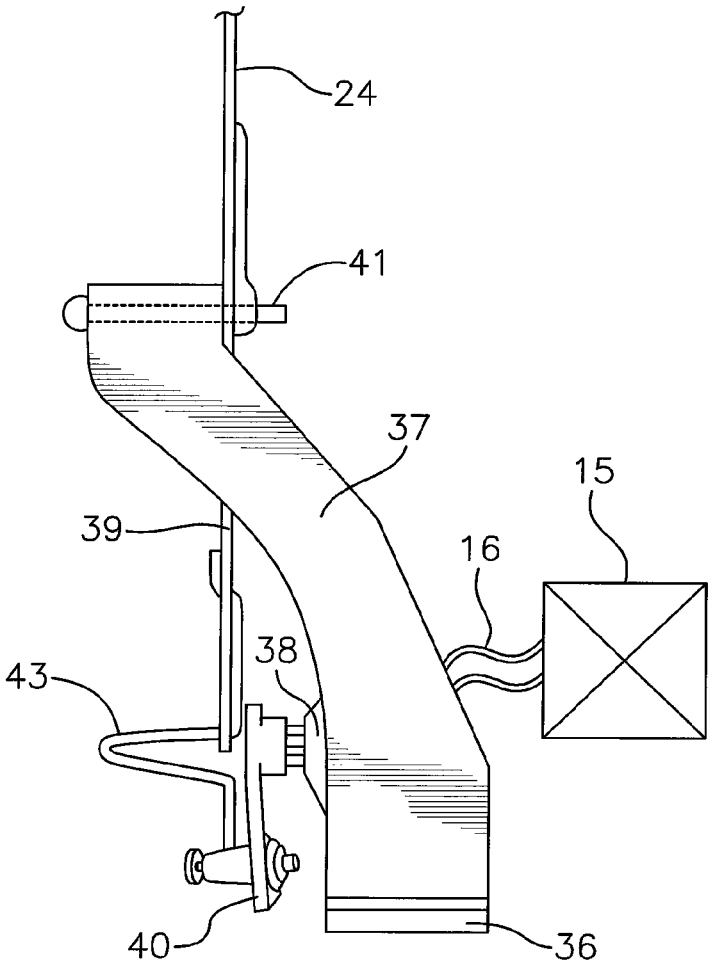
FIG. 6 is right side view of the wing actuation assembly, showing its connection to a generic control system.
Figure 7:
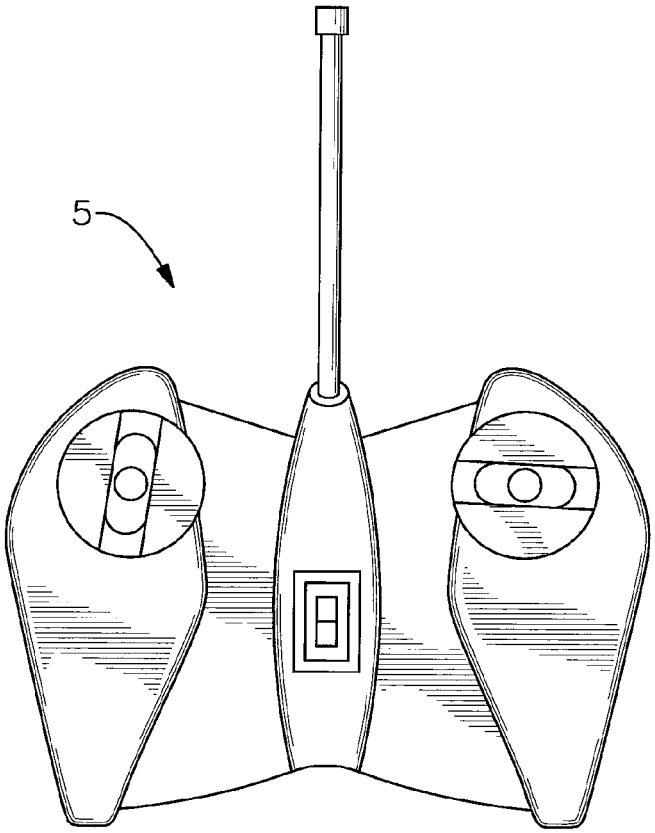
FIG. 7 is a top view of a typical wireless control device.

Referring to FIGS. 4-6, the wing actuation assembly 35 comprises the components necessary to actuate wing 22 movement in a flapping motion. For example, in one embodiment the wing actuation assembly 35 comprises a frame having a base 36, vertical struts 37, and a servo 38. The servo 38 has wires 16 connecting it to the control system 15 components, such as the battery. The servo 38 has a rotating arm 40, which is connected to a linking assembly 39. As the arm 40 rotates, the motion of the arm 40 drives the linking assembly 39 up and down in a cyclical manner. The linking assembly 39 is connected to the base 28 of the first spine 24, and each of the first spines 24 is attached to the adjacent strut 37 by an axle member 41. As the linking assembly 39 moves up and down in a cyclical oscillation, the linking assembly 39 articulates the base 28 in the same motion, causing the first spine 24 to rotate about the axle member 41. The resulting cyclical oscillation of the first spine 24 causes the wing 22 to move in a corresponding upstroke and down stroke motion, causing the flapping movement.

On one embodiment of the wing articulation assembly 35, the base 36 and struts 37 are integral members folded to form the necessary structural support for the wing actuation assembly 35. In this embodiment, and depending on the configuration of the winged body 20, as the arm 40 rotates the struts 37 are required to move apart to allow ample lateral clearance for the arm 40 in its horizontal position. Flexibility is promoted by a joint assembly 42 at the corners of the base 36/strut 37 connection point. For example, the joint assembly 42 could be notches 42 that create a thinner cross section of the base 36/strut 37 material, thereby promoting flexibility of the joint assembly 42 and accommodating lateral movement of the struts 37 relative to the servo 38 and the rotating arm 40. A hinge-type joint assembly 42 could accomplish the same purpose. The joint assemblies 42 provide additional degrees of freedom to the wing actuation assembly 35. That is, the combination of the axle members 41 at the top of the struts 37, and the joint assemblies 42 at the bottom of the struts 37 provide significant lateral flexibility to the wing actuation assembly 35, and therefore to the body 20. This flexibility enhances the durability of the hovering toy FIG. 99 under the impact forces caused by collisions and crash landings.

In many embodiments, the movement of the linking assembly 39 creates a jarring force on the first spines 24. Thus, one embodiment of the linking assembly 39 includes a spring member 43 that is configured to soften the jarring motion of the linking assembly, thereby softening the actuating effect on the first spines 24.

During flight, the lift and control of the hovering toy FIG. 99 is controlled and driven by the propulsion system 10. In other words, the aerodynamic forces produced by the wings 22 are not the main forces lifting and maneuvering the hovering toy FIG. 99. However, as the wings 22 flap, they produce an uplift force on the hovering toy FIG. 99. Thus, during flight the flapping wings 22 cause a "bouncing" effect, making the hovering toy FIG. 99 appear to be life-like during flight. The bouncing effect becomes more pronounced when there are no wing apertures 23, or when such apertures 23 are relatively small. The bouncing effect is minimized, or even eliminated, when the area of the apertures 13 approaches that of the overall wing 12 surface. In most embodiments, a pleasant bouncing flight is produced when the apertures 23 are in the range of about 60 percent to about 80 percent of the wing 12 surface.

In one embodiment, the wings 22 flap in a substantially vertical direction that is perpendicular or near perpendicular to the ground. However, to further enhance the life-like appearance of the hovering toy FIG. 99, in another embodiment the wings 22 pivot about an axis that is inclined at an angle 51 of about 45-degrees from horizontal. See FIG. 1. An orientation angle 51 that varies from about 5-degrees to about 75-degrees will produce similarly pleasing results. Depending on the embodiment, angles in the range of about 75-degrees to about 85-degrees produce a bouncing effect that appears more accurate for the particular embodiment, such as for fanciful winged creatures. As an added benefit, a steeper angle 51 also enables a more horizontal orientation to the flapping motion of the wings 22, thereby providing greater clearance between the wings 22 and the primary rotor 56 and secondary rotor 59 discussed below. In one embodiment, the angle 51 is approximately 90-degrees, producing a flapping motion with a forward stroke and a backward stroke rather than a down stroke and an upstroke.

The orientation and location of the control system 15 components can be adjusted with respect to the propulsion system 10 and winged body 20 so that the FIG. 99 remains balanced during flight. In other words, the components of the control system 15 can be placed within the body 20 to adjust the center of gravity of the overall hovering toy FIG. 99. For example, the battery, one of the heavier components of the hovering toy FIG. 99, can be placed in proximity to rearward position within the FIG. 99, especially in embodiments when the wing actuation assembly 35 is placed in proximity to a forward position within the FIG. 99. The control system 15 can also be oriented to serve as a ballast to counter balance the momentum of the flapping wings 22. The precise orientation of the control system 15 components will depend on the overall shape and configuration of the hovering toy FIG. 99. Likewise, the struts 37 of the wing actuation assembly 35 can be curved or shaped so that the center of gravity of the wing actuation assembly 35 can be adjusted with respect to the other components of the flying toy FIG. 99. See FIGS. 1 & 6.

In one specific embodiment of the hovering toy FIG. 99, the wing actuation assembly 35 comprises 2 mm thick corrugated plastic configured in a "U-shape" with the servo 38 mounted centrally. The struts 37 are the arms of the U, and the base 36 is the bottom of the trough. The servo 38 is a CSRC-35, 3-gram servo with the gears modified to spin continuously, and the other electronics other than the motor are removed. The battery is a 3.7 volt, 300 mAh, 20*c* battery that is common in the RC toy industry. The winged body 20 is made of 0.006-inch (0.15 mm) thick Mylar sheet. The quadcopter used for the propulsion system 10 is a WL Toys QR series Ladybird V939 with a 3-axis gyroscope unit for stabilization. As another alternative, the propulsion system 10 could be a UdiRC U816A 2.4G with a 6-axis gyroscope for improved stability. Both of these propulsion systems 10 polycopters have a 2.4 Ghz, four-channel radio system.

In another embodiment, the propulsion system 10 can be removed, as shown in FIG. 1. In this embodiment, the toy FIG. 99 is not a hovering device. Instead, without the propulsion system 10, the toy FIG. 99 is a handheld toy with flapping wings 22. In this embodiment, the control system 15 (shown in FIG. 6) primarily comprises a battery to power the wing actuation assembly 35, which remains as described above. In this handheld toy embodiment, the control system 15 can be configured with or without a receiver for receiving a wireless signal, depending on whether a wireless control device 5 is used to control the action of the wings 22.

In one embodiment, the wings 22 and the wing actuation assembly 35 are contained in a single wing assembly unit, without a propulsion system 10, and without a body 20. Examples of this self-contained wing assembly unit are represented in FIGS. 4-6. In this embodiment, the wing assembly unit is configured for attachment to other action figures as desired. For example, the wing assembly unit could be fitted to an action figure that takes the form of a wingless male human. Attaching the wing assembly unit to such an action figure creates a Batman-like appearance to the action figure. In this manner, the user can create many different permutations of winged toy figures by combining the wing assembly unit with pre-existing action figures, as desired.

Figure 8:
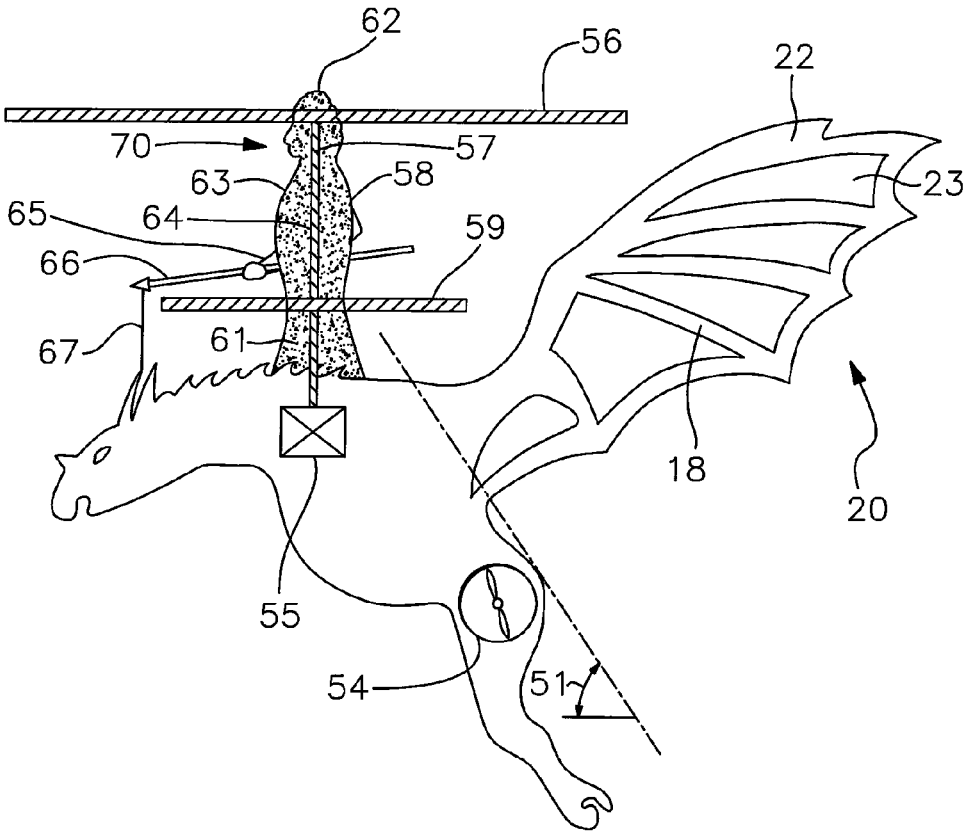
FIG. 8 is a cross section of one embodiment of the hovering toy figure having a riding figure, without the wing actuation assembly shown.

In another embodiment, shown in FIG. 8, the quadcopter or hexacopter units of the propulsion system 10 are removed and replaced with one or more rotors in a coaxial arrangement. For example, in this embodiment the propulsion system 10 comprises a motor drive 55 driving a primary rotor 56 via a rotor mast 57, which is supported by a housing 58. A secondary rotor 59 is operatively engaged by the motor drive 55. The motor drive 55 comprises one or more motors for operating the primary rotor 56, secondary rotor 59, and any other rotors, as will be appreciated by a skilled practitioner. Additional rotors or stability bars can be added to the rotor mast 57 as needed or desired. The primary rotor 56 and the secondary rotor 59 can be configured to spin in the same direction or in opposite directions.

When the primary rotor 56 and the secondary rotor 59 spin in opposite directions, there is no need for a stabilizer rotor 54. However, if the propulsion system 10 comprises only a primary rotor 56 with no secondary rotor 59, or if the primary rotor 56 and the secondary rotor 59 spin in the same direction, then a stabilizer rotor 54 is needed for angular stability of the FIG. 99. Alternately, the stabilizer rotor 54 could be located at the front of the hovering toy FIG. 99, such as in the nose or neck area of the toy FIG. 99 (not shown). There are a variety of arrangements of the primary rotor 56, the secondary rotor 59, additional rotors, stability bars, stabilizer rotors 54, and motor drives 55 that are suitable for operation of the hovering toy FIG. 99, as will be appreciated by a skilled practitioner. In each of the foregoing embodiments, the motor drive 55 is operatively connected to and controlled by the control system 15.

The housing 58 provides lateral bracing to the rotor mast 57, which typically is a slender vertical member. The housing 58 aids in preventing buckling, wobbling, or other lateral vibration of the rotor mast 57 during operation. The housing 58 comprises an opening 64, such as a hollow cylindrical shaft, sized to snugly receive the rotor mast 57 in a manner permitting the rotor mast 57 to spin relatively friction free.

In one embodiment, the housing 58 is configured in the shape of a riding FIG. 70 riding the hovering toy FIG. 99. In an embodiment of the propulsion system 10 comprising only a primary rotor 56, the housing 58 comprises a lower segment 61 located below the primary rotor 56 and an upper segment 62 located above the primary rotor 56. The lower segment 61 is attached to the winged body 20 such that the orientation of the lower segment 61 is fixed in relation to the winged body 20. The shape of the lower segment 61 depends on the placement of the primary rotor 56. For example, if the primary rotor 56 is located at or near the location of the waist of the riding FIG. 70, then the lower segment 61 takes the shape of legs attached to the winged body 20. If the primary rotor 56 is attached above the shoulder area of the riding FIG. 70, then the lower segment 61 takes the shape of the torso and legs of the riding FIG. 70. In each embodiment, the upper segment 62 is attached to the rotor mast 57 and spins with the primary rotor 56, with the lower segment 61 being attached to the winged body 20 and remaining fixed with respect to the winged body 20 as the rotor mast 57 spins inside the hollow cylindrical shaft 64 of the lower segment 61.

In an embodiment with a primary rotor 56 and the secondary rotor 59, the housing 58 further comprises a middle segment 63 located between the primary rotor 56 and the secondary rotor 59. The middle segment 63 is configured in the shape of the torso of the riding FIG. 70. The middle segment 63 comprises an arm 65 of the riding FIG. 70 that holds a spear 66. A retaining member 67 connects the spear 66 to the winged body 20, such as a horn on the head of the winged body 20. In this manner, the retaining member 67 prevents the middle segment 63 from spinning as the rotor mast 57 spins inside the hollow cylindrical shaft 64 of the middle segment 63. The lower segment 61, which remains securely attached to the winged body 20, takes the form of the legs of the riding figure, and the upper segment 62 is as described above. The retaining member 67 is a wire, rod, strap, or other member configured to retain the middle segment 63 from spinning with the rotor mast 57.

In any of the embodiment comprising a primary rotor 56 or a secondary rotor 59, the wing actuation assembly 35 is as described above. However, the angle 51 is increased to the range of about 50 to about 80 degrees, thereby orienting the wings 22 in a more horizontal flapping direction and emphasizing the horizontal component of flapping motion. In one embodiment, the angle 51 is about 70 degrees. One of the advantages of this increased angle 51 is to promote flapping of the wings 22 in a manner that does not interfere with operation of the primary rotor 56 or the secondary rotor 59. Depending on the configuration of the wings 22, the increased angle 51 alters the bouncing effect of the flight by creating a more pronounced horizontal component to the aerodynamic force produced by the flapping wings 22.

The foregoing embodiments are merely representative of the hovering toy figure and not meant for limitation of the invention. For example, one having ordinary skill in the art would appreciate that there are several embodiments and configurations of wing members, propulsion systems, or wing actuation assemblies that will not substantially alter the nature of the hovering toy figure. Consequently, it is understood that equivalents and substitutions for certain elements and components set forth above are part of the invention described herein, and the true scope of the invention is set forth in the claims below.

I claim:

1. A remote controlled hovering toy figure comprising:

a body having at least two wings, each wing having a support and a tip;

a propulsion system mounted to the body, said propulsion system configured for producing a hovering form of flight for the hovering toy figure;

a control system for controlling the propulsion system, said control system configured to receive electronic signals from a wireless control device; and a wing actuation system for actuating the wings in a flapping motion, thereby simulating the flapping motion of the hovering toy figure.

2. The hovering toy figure of claim 1, wherein the propulsion system comprises at least three propeller units arranged in a substantially co-planar configuration.

3. The hovering toy figure of claim 1, wherein at least one of the wings comprises a first spine and a second spine, the first spine having has a base and a distal end, the base being operably connected to the wing actuation assembly such that the first spine extends along the wing and the distal end extends beyond a first spine connectivity termination point, the second spine being attached to the wing at a second spine connectivity termination point that is located on the wing between the first spine connectivity termination point and the tip of the wing such that a space between the first spine connectivity termination point and the second spine connectivity termination point is a flex zone in the wing, wherein the second spine is oriented such that the distal end of the first spine and a tip of the second spine cross in proximity to the flex zone.

4. The hovering toy figure of claim 2, wherein at least one of the wings comprises a first spine and a second spine, the first spine having has a base and a distal end, the base being operably connected to the wing actuation assembly such that the first spine extends along the wing and the distal end extends beyond a first spine connectivity termination point, the second spine being attached to the wing at a second spine connectivity termination point that is located on the wing between the first spine connectivity termination point and the tip of the wing such that a space between the first spine connectivity termination point and the second spine connectivity termination point is a flex zone in the wing, wherein the second spine is oriented such that the distal end of the first spine and a tip of the second spine cross in proximity to the flex zone.

5. The hovering toy figure of claim 1, wherein at least one of the wings comprises one or more apertures configured to enable the passage of air through the wing, thereby reducing aerodynamic forces produced by the wing during the flapping motion, and producing a bouncing effect to the hovering form of flight.

6. The hovering toy figure of claim 2, wherein at least one of the wings comprises one or more apertures configured to enable the passage of air through the wing, thereby reducing aerodynamic forces produced by the wing during the flapping motion, and producing a bouncing effect to the hovering form of flight.

7. The hovering toy figure of claim 3, wherein at least one of the wings comprises one or more apertures configured to enable the passage of air through the wing, thereby reducing aerodynamic forces produced by the wing during the flapping motion, and producing a bouncing effect to the hovering form of flight.

8. The hovering toy figure of claim 1, wherein the propulsion system comprises a motor drive driving a primary rotor via a rotor mast.

9. The hovering toy figure of claim 8, further comprising a housing to support the rotor mast against lateral vibration.

10. The hovering toy figure of claim 8, wherein at least one of the wings comprises a first spine and a second spine, the first spine having has a base and a distal end, the base being operably connected to the wing actuation assembly such that the first spine extends along the wing and the distal end extends beyond a first spine connectivity termination point, the second spine being attached to the wing at a second spine connectivity termination point that is located on the wing between the first spine connectivity termination point and the tip of the wing such that a space between the first spine connectivity termination point and the second spine connectivity termination point is a flex zone in the wing, wherein the second spine is oriented such that the distal end of the first spine and a tip of the second spine cross in proximity to the flex zone.

11. The hovering toy figure of claim 9, wherein at least one of the wings comprises a first spine and a second spine, the first spine having has a base and a distal end, the base being operably connected to the wing actuation assembly such that the first spine extends along the wing and the distal end extends beyond a first spine connectivity termination point, the second spine being attached to the wing at a second spine connectivity termination point that is located on the wing between the first spine connectivity termination point and the tip of the wing such that a space between the first spine connectivity termination point and the second spine connectivity termination point is a flex zone in the wing, wherein the second spine is oriented such that the distal end of the first spine and a tip of the second spine cross in proximity to the flex zone.

12. The hovering toy figure of claim 8, wherein at least one of the wings comprises one or more apertures configured to enable the passage of air through the wing, thereby reducing aerodynamic forces produced by the wing during the flapping motion, and producing a bouncing effect to the hovering form of flight.

13. The hovering toy figure of claim 1, wherein the propulsion system comprises a motor drive driving a primary rotor and a secondary rotor via at least one rotor mast, wherein the primary rotor and the secondary rotor are arranged in a coaxial configuration, and the secondary rotor is located at a height on the at least one rotor mast that is lower than the height of the primary rotor.

14. The hovering toy figure of claim 13, further comprising a housing to support the at least one rotor mast against lateral vibration, wherein the housing comprises a lower segment and an upper segment, the lower segment being attached to the body and disposed around the at least one rotor mast below the location of the primary rotor, and the upper segment is disposed around the at least one rotor mast above the location of the primary rotor.

15. The hovering toy figure of claim 13, wherein at least one of the wings comprises a first spine and a second spine, the first spine having has a base and a distal end, the base being operably connected to the wing actuation assembly such that the first spine extends along the wing and the distal end extends beyond a first spine connectivity termination point, the second spine being attached to the wing at a second spine connectivity termination point that is located on the wing between the first spine connectivity termination point and the tip of the wing such that a space between the first spine connectivity termination point and the second spine connectivity termination point is a flex zone in the wing, wherein the second spine is oriented such that the distal end of the first spine and a tip of the second spine cross in proximity to the flex zone.

16. The hovering toy figure of claim 14, wherein at least one of the wings comprises a first spine and a second spine, the first spine having has a base and a distal end, the base being operably connected to the wing actuation assembly such that the first spine extends along the wing and the distal end extends beyond a first spine connectivity termination point, the second spine being attached to the wing at a second spine connectivity termination point that is located on the wing between the first spine connectivity termination point and the tip of the wing such that a space between the first spine connectivity termination point and the second spine connectivity termination point is a flex zone in the wing, wherein the second spine is oriented such that the distal end of the first spine and a tip of the second spine cross in proximity to the flex zone.

17. The hovering toy figure of claim 13, wherein at least one of the wings comprises one or more apertures configured to enable the passage of air through the wing, thereby reducing aerodynamic forces produced by the wing during the flapping motion, and producing a bouncing effect to the hovering form of flight.

18. The hovering toy figure of claim 14, wherein at least one of the wings comprises one or more apertures configured to enable the passage of air through the wing, thereby reducing aerodynamic forces produced by the wing during the flapping motion, and producing a bouncing effect to the hovering form of flight.

* * * * *

UNITED STATES PATENT AND TRADEMARK OFFICE

CERTIFICATE OF CORRECTION

PATENT NO. : 9,072,981 B2
APPLICATION NO. : 14/277902
DATED : July 7, 2015
INVENTOR(S) : Gregory David Tanous It is certified that error appears in the above-identified patent and that said Letters Patent is hereby corrected as shown below:

In the specification:

Column 3,
Lines 8, 10, 19, 21, 25, 28, 45, 49, and 62, "FIG. 99", each occurrence, should read --figure 99--.

Column 4,
Lines 9, 54, 55, and 61, "FIG. 99", each occurrence, should read --figure 99--.

Column 5,
Line 53, "FIG. 99" should read --figure 99--.

Column 6,
Lines 11, 12, 15, 17, 19, and 61, "FIG. 99", each occurrence, should read --figure 99--.

Column 7,
Lines 4, 5, 8, 9, 11, 23, 41, 44, 46, 47, 49, 53, 57, and 58, "FIG. 99", each occurrence, should read --figure 99--.

Column 8,
Lines 9, 10, 51, 52, 53, and 57, "FIG. 99", each occurrence, should read --figure 99--.

Column 9,
Line 2, "FIG. 99" should read --figure 99--; and
Lines 2, 12, 14, 16, 26, and 27, "FIG. 70", each occurrence, should read --figure 70--.

Signed and Sealed this
Fifth Day of April, 2016

Michelle K. Lee

Michelle K. Lee
*Director of the United States Patent and Trademark Office*